United States Patent [19]

Oster

[11] 4,028,543

[45] June 7, 1977

[54] BASELESS LAMP

[75] Inventor: Joseph Oster, Allentown, Pa.

[73] Assignee: Keystone Lamp Manufacturing Corporation, Slatington, Pa.

[22] Filed: Mar. 3, 1976

[21] Appl. No.: 663,320

[52] U.S. Cl. ..... 240/52.1; 240/4; 240/69; 240/73 R; 248/123

[51] Int. Cl.[2] ..... F21V 21/08; F21V 21/20; A47G 29/30

[58] Field of Search ..... 240/69, 52.1, 1 R, 2 D, 240/4, 52 R, 52 BL, 73 R, 73 QD, 81 R, 81 BS, 81 BA, 90; 248/331, 364, 162, 123

[56] References Cited

UNITED STATES PATENTS

| | | | |
|---|---|---|---|
| 3,330,950 | 7/1967 | Lawson et al. | 240/52.1 |
| 3,356,841 | 12/1967 | Horan | 240/81 R |
| 3,543,017 | 11/1970 | Mihailoff | 240/4 |

*Primary Examiner*—Edna M. O'Connor
*Attorney, Agent, or Firm*—Seidel, Gonda & Goldhammer

[57] ABSTRACT

An elongated tubular element is bent to form an upwardly extending vertical portion, a downwardly extending vertical portion and a horizontal portion joining the two vertical portions and functioning as a support element. A lamp fixture is mounted adjacent the top of the upwardly extending vertical portion and a counterweight is mounted adjacent the lower end of the downwardly extending vertical portion. The counterweight causes the center of gravity of the lamp to be below the horizontal portion of the tubular element so that when the horizontal portion is resting on a support surface, the lamp is balanced in a substantially upright position.

6 Claims, 4 Drawing Figures

FIG. 1
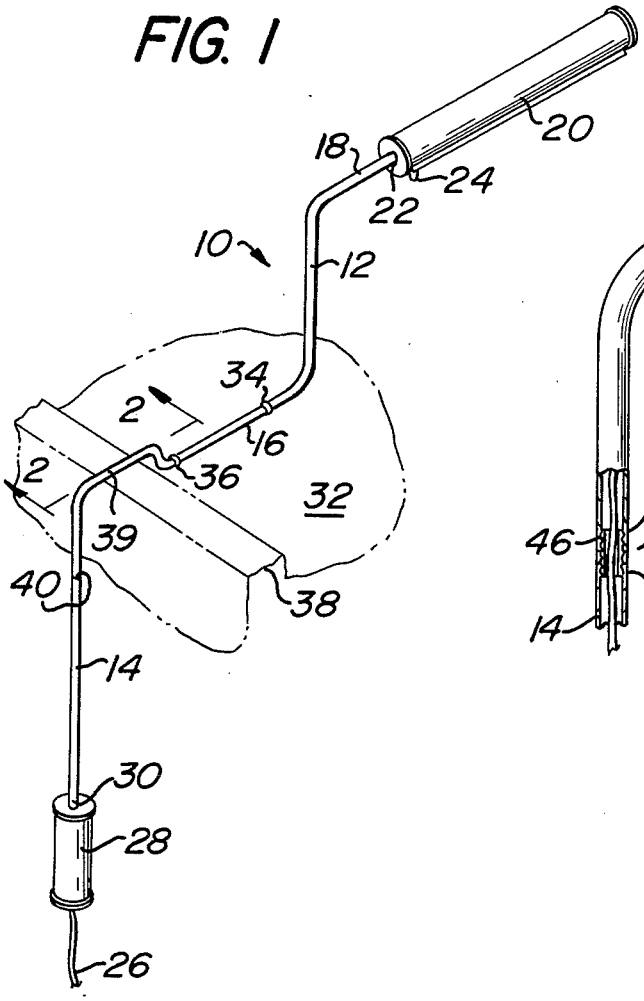
FIG. 2
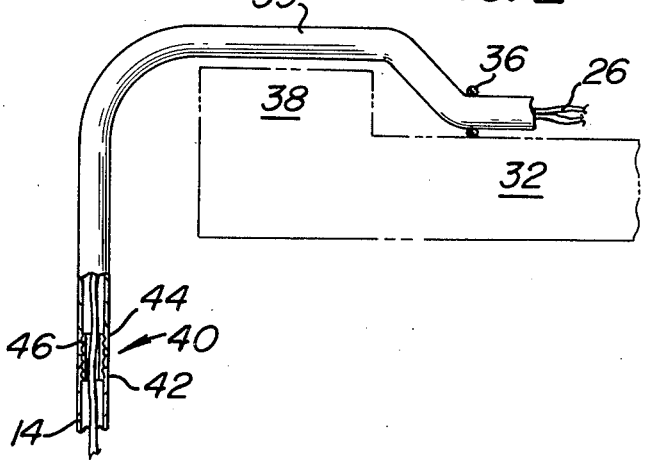
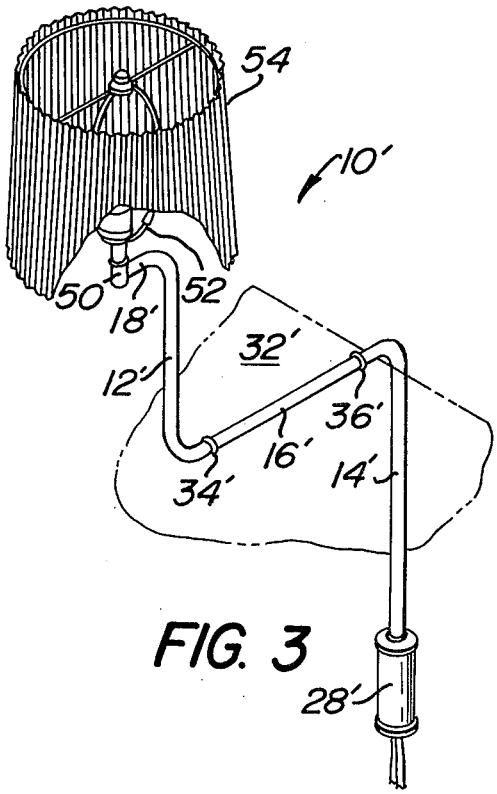
FIG. 3
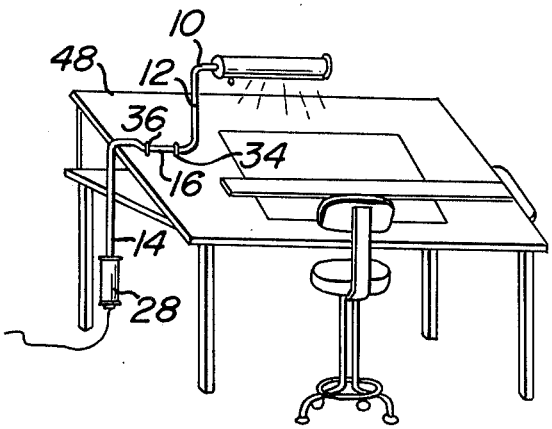
FIG. 4

BASELESS LAMP

BACKGROUND OF THE INVENTION

The present invention is directed toward a lamp and more particularly toward a baseless lamp which can easily be moved from one place to another and which includes a support element which allows the lamp to be supported on a wide variety of support surfaces. The lamp of the present invention requires only an extremely narrow support surface and accordingly is well suited as a piano lamp.

Lamps of the general character of those described herein have been proposed in the past. One such lamp is described, for example, in U.S. Pat. No. 3,330,950 . This lamp includes a supporting plate having a cushion layer of resilient material on the bottom side thereof. A first elongated tubular member extends downwardly from the supporting plate and has a counterweight at the lower end thereof. A second, upwardly extending tubular element extends upwardly from the supporting plate and has a lamp fixture fastened to the upper end thereof. The two elongated tubular elements are coaxial. This lamp is unsatisfactory for several reasons. Because of the shape of the supporting plate, the lamp can be supported in an upright position only if the support surface on which the lamp rests is horizontal. In addition, because of the shape of the supporting plate the support surface upon which the lamp rests must be relatively wide. Furthermore, while the counterweight may tend to prevent side to side pivotal movement of the lamp, it would not provide an adequate counterbalancing effect in the forward and/or backward directions. As a result, the lamp fixture must be mounted very close to the axis of the tubular support members and cannot extend too far outwardly therefrom. And, most importantly, the lamp described in patent 3,330,950 is relatively expensive to manufacture since it is comprised of several different parts which must be separately manufactured and then assembled.

SUMMARY OF THE INVENTION

The present invention overcomes all of the above described disadvantages of the prior art and includes an elongated tubular element which is bent to form an upwardly extending vertical portion, a downwardly extending vertical portion and a horizontal portion joining the two vertical portions. The horizontal portion of the tubular element functions as the support element so that no additional support plate, or the like, is needed. Both vertical portions and the horizontal portion may be made from a single elongated tubular element or from two or more elements joined together. Rubber O-rings surround the horizontal portion to provide a resilient friction means on the support element. A lamp fixture is mounted adjacent the top of the upwardly extending vertical portion and a counterweight is mointed adjacent the lower end of the downwardly extending vertical portion.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a perspective view of a first embodiment of a lamp constructed in accordance with the principles of the present invention;

FIG. 2 is a front view of a portion of the lamp taken along the lines 2—2 of FIG. 1;

FIG. 3 is a perspective view of a second embodiment of the invention, and

FIG. 4 is a view similar to FIG. 1 showing the manner in which the lamp of the present invention may be used.

DETAILED DESCRIPTION OF THE INVENTION

Referring now to the drawing in detail wherein like numerals indicate similar elements throughout the Figures, there is shown in FIG. 1 one embodiment of a lamp constructed in accordance with the principles of the present invention and designated generally at 10. The support for lamp 10 is comprised essentially of an elongated tubular member which is bent so as to form an upwardly extending vertical portion 12, a downwardly extending vertical portion 14 and a substantially horizontal portion 16. Horizontal portion 16 is connected between the lower end of vertical portion 12 and the upper end of vertical portion 14 and functions as a support element for the lamp 10. A small second horizontal portion 18 extends from the top of the upwardly extending vertical portion 12 and has an elongated horizontally extending lamp fixture 20 attached to the free end thereof. Lamp fixture 20 is connected to the small horizontal portion 18 in a conventional manner such as by a threaded connection 22. A switch 24 mounted on the lamp fixture 20 is used to turn the lamp on and off. Power is supplied to the lamp through a conventional lamp cord 26 which passes through the interior of the entire tubular lamp support to the lamp fixture 20 so that the lamp cord 26 is totally hidden and is exposed only at the very lowermost end of the lamp 10.

A counterweight 28, the purpose for which will be made clear hereinafter, is connected to the lowermost end of downwardly extending vertical portion 14 in a conventional manner such as a threaded connection 30. As stated above, horizontal portion 16 functions as a support element such that the entire lamp 10 may be supported on a substantially planar support surface such as shown at 32. A pair of spaced apart elastomeric rubber O-rings 34 and 36 surround horizontal portion 16 and function as resilient friction means. O-rings 34 and 36 prevent the lamp 10 from sliding and protect the support surface 32 from being scratched by the lamp 10.

It should be clear from FIGS. 1 and 2 that the entire weight of the lamp 10 is supported by the bottom of the O-ring 34 and 36 and that no other part of the lamp 10 contacts support surface 32 or any other surface. In other words, the lamp 10 is actually suspended by O-rings 34 and 36. This result is accomplished by the configuration of the elongated tubular support member, the weight of lamp fixture 20 and the weight of counter-weight 28. Briefly stated, the weight of counterweight 28 is chosen so that the center of gravity of the entire lamp will lie below the horizontal portion 16. In this way, the counterweight 28 will hang downwardly preventing arcuate motion of the lamp about the horizontal portion 16. In addition, the weight of counterweight 28 is selected such that the center of gravity is in a plane perpendicular to the horizontal portion 16 and lying between the O-rings 34 and 36. With the center of gravity between the O-rings 34 and 36, movement of the lamp 10, upwardly or downwardly, is prevented. It should be clear that if the weight of lamp fixture 20 is changed, or if the distance from lamp fixture 20 to the horizontal portion 16 is changed (such as by changing the shape of lamp fixture 20) the weight of counterweight 28 will have to be adjusted accordingly so as to bring the center of gravity of the system back to its proper place.

In view of the fact that the entire lamp is supported by the O-rings 34 and 36, it can be seen in FIGS. 1 and 2 that the lamp of the present invention is well suited for use as a piano lamp. The lamp, for example, may be placed on the narrow ridge of the piano above the keyboard. And since most pianos include a raised edge such as shown at 38, horizontal portion 16 of lamp 10 is bent so as to form an upwardly extending hump 39. As shown most clearly in FIG. 2, hump 39 is of sufficient height to clear the raised edge 38 without contacting the same.

While the entire elongated tubular support member comprising vertical portions 12 and 14 and horizontal portion 16 may be made from a single metal tubular element (or some other similar material) it may also be made from several distinct tubular members which are joined together. For example, as shown in FIGS. 1 and 2 the elongated tubular support member is comprised essentially of two parts which are joined together at 40. This may be done in any conventional manner such as by providing internal threads 42 and 44 at the ends of the tubular members which may be screwed on to a hollow bolt 46. By having the elongated tubular support member made in two or more parts, the lamp can be easily knocked down for shipping and easily reassembled by the purchaser. In addition, the O-rings 34 and 36 do not have to be preassembled on the horizontal portion 16 but can merely be supplied with the lamp 10. The purchaser can than be easily slip the O-rings 34 and 36 onto the tubular support member and into their proper position before he assembles the lamp.

A slightly modified form of lamp 10 is shown in FIG. 3 and is designated generally at 10'. As with lamp 10, lamp 10' includes a tubular support member having an upwardly extending vertical portion 12', a downwardly extending vertical portion 14' and a horizontal portion 16'. O-rings 34' and 36' support the lamp 10' on a planar surface 32'. Since the surface 32' does not include any raised portions such as the piano edge 38, horizontal portion 16' does not include any hump means therein. A small horizontal portion 18' adjacent to the top of the upwardly vertical portion 12' supports a vertically extending lamp fixture 50. Lamp fixture 50 includes a conventional harp 52 which supports a lamp shade 54. As shown, the small horizontal portion 18' is somewhat smaller than the similar portion 18 shown in FIG. 1. However, it should be readily apparent that the length of portion 18' (or 18) may be increased or decreased as desired. It must be remembered, that if the length of the horizontal portion 18' or 18 is increased significantly, the weight of counterweight 28' or 28 may have to be increased in order to bring the center of gravity of the lamp back into its proper position.

FIG. 4 illustrates another of the advantages of the lamp 10 of the present invention. As shown in FIG. 4, the lamp 10 is resting on a support surface 48 such as a drafting table. While the support surface 48 is substantially planar, it is also substantially inclined from the horizontal. However, since the lamp it totally supported by the O-rings 34 and 36, it can be seen that the counterweight 28 continues to balance the lamp 10 into it upright position. In other words, the downwardly extending portion 14 and the upwardly extending portion 12 remain substantially vertical. There is, of course, a limit to the degree of inclination of support surface 48. However, this is determined by the co-efficient of friction between the O-rings 34 and 36 and the support surface 48 and not by the design of the lamp 10.

The present invention may be embodied in other specific forms without departing from the spirit or essential attributes thereof and, accordingly, reference should be made to the appended claims, rather than to the foregoing specification as indicating the scope of the invention.

I claim:

1. A lamp comprising:

an elongated tubular support member;

said support member having a substantially downwardly extending portion, a substantially upwardly extending portion spaced from said downwardly extending portion and a substantially horizontally extending portion connected between the lower end of said upwardly extending portion and the upper end of said downwardly extending portion;

friction means covering at least part of at least the underside of said horizontally extending portion, said friction means being adapted to rest on a support surface for supporting said lamp;

a lamp fixture mounted on said upwardly extending portion of said support member adjacent the upper end thereof; and a counterweight means mounted on said downwardly extending portion of said lamp support adjacent the lower end thereof, the weight of said counterweight means being such that the center of gravity of the lamp is below said horizontally extending portion whereby said lamp is balanced in a substantially upright position when said friction means is resting on a support surface.

2. A lamp as claimed in claim 1 wherein the upper end of said upwardly extending portion of said support member includes a substantially horizontal portion extending away from said downwardly extending portion, said lamp fixture being mounted on the free end of said horizontal portion.

3. A lamp as claimed in claim 2 wherein said lamp fixture is elongated and extends horizontally from said end of said horizontal portion and substantially in line with said horizontal portion.

4. A lamp as claimed in claim 1 wherein said friction means comprises a pair of spaced apart O-rings surrounding said horizontally extending portion of said support member.

5. A lamp as claimed in claim 4 wherein the center of gravity of the lamp lies in a plane perpendicular to said horizontally extending portion of said support member and between said pair of spaced apart O-rings.

6. A lamp as claimed in claim 1 wherein said horizontally extending portion includes an upwardly extending hump section adjacent the upper end of said downwardly extending portion of said tubular support member.

* * * * *